US012566025B2

(12) United States Patent
Allgeier et al.

(10) Patent No.: US 12,566,025 B2
(45) Date of Patent: Mar. 3, 2026

(54) REFRIGERATOR APPLIANCE ANTI-RACKING SLIDING DRAWER

(71) Applicant: Haier US Appliance Solutions, Inc., Wilmington, DE (US)

(72) Inventors: Brian Allgeier, Louisville, KY (US); Louis A. Wantland, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/598,779

(22) Filed: Mar. 7, 2024

(65) Prior Publication Data

US 2025/0283655 A1 Sep. 11, 2025

(51) Int. Cl.
*F25D 23/06* (2006.01)

(52) U.S. Cl.
CPC ..... *F25D 23/067* (2013.01)

(58) Field of Classification Search
CPC ..... F25D 23/067; F25D 25/025
See application file for complete search history.

(56) References Cited

U.S. PATENT DOCUMENTS 4,579,402 A * 4/1986 Wenzlick ..... A47B 88/427 312/330.1
6,971,730 B2 * 12/2005 Koons ..... F25D 25/025 312/402
7,997,667 B2 8/2011 Rotter et al.
8,141,966 B2 * 3/2012 Placke ..... F25D 25/024 312/334.7
8,382,218 B2 * 2/2013 Placke ..... F25D 25/025 312/334.7
8,403,437 B2 * 3/2013 Bergmann ..... F25D 25/021 312/334.1
8,434,837 B2 * 5/2013 Lee ..... F25D 25/025 312/402
8,511,767 B2 * 8/2013 Haidar ..... F25D 25/025 312/402
8,562,087 B2 * 10/2013 Eom ..... F25D 25/025 312/331
8,668,290 B2 3/2014 Rotter et al.
8,931,863 B2 1/2015 Vulava
9,557,096 B2 * 1/2017 Hong ..... F25D 23/021
(Continued)

FOREIGN PATENT DOCUMENTS

CA 2757890 C 9/2014
CN 106196870 A * 12/2016 ..... F25D 25/025
(Continued)

*Primary Examiner* — Hanh V Tran
(74) *Attorney, Agent, or Firm* — Dority & Manning, P.A.

(57) ABSTRACT

A slidably mountable drawer assembly for a refrigerator appliance is provided. The drawer assembly includes a drawer defining a chamber between a first side and a second side. The drawer assembly also includes a first rail, and a second rail. A drawer flange extends laterally from both the first side and second side of the drawer. The drawer flange is configured to engage with both the first rail and the second rail. The drawer comprises one or more tabs extending from the drawer flange on at least one of the first side and second side of the drawer. The one or more tabs are each configured to engage a respective one of a first slot in the first rail or a second slot in the second rail.

17 Claims, 7 Drawing Sheets

(56) References Cited

U.S. PATENT DOCUMENTS

| | | | | |
|---|---|---|---|---|
| 9,901,171 | B1 * | 2/2018 | Dubina | F25D 25/025 |
| 10,012,431 | B2 | 7/2018 | Dickerson et al. | |
| 10,485,250 | B2 * | 11/2019 | Carballo | A23B 2/80 |
| 10,533,791 | B2 * | 1/2020 | Gatter | F25D 23/067 |
| 11,255,600 | B2 | 2/2022 | Hong et al. | |
| 11,384,978 | B2 * | 7/2022 | Bai | F25D 25/025 |
| 2008/0203875 | A1 * | 8/2008 | Lim | F25D 23/021 312/404 |
| 2012/0079845 | A1 * | 4/2012 | Hong | F25D 25/025 312/402 |
| 2017/0367480 | A1 | 12/2017 | Dickerson et al. | |
| 2022/0316793 | A1 * | 10/2022 | Hanson | B01D 53/229 |

FOREIGN PATENT DOCUMENTS

| | | | | | |
|---|---|---|---|---|---|
| CN | 109028741 | A * | 12/2018 | | F25D 25/025 |
| DE | 112010005115 | B4 * | 8/2020 | | F25D 25/025 |
| JP | H04116376 | A | 4/1992 | | |
| KR | 20190019452 | A * | 2/2019 | | A47B 88/43 |
| WO | WO-2011118137 | A1 * | 9/2011 | | F25D 25/025 |
| WO | WO-2013031149 | A2 * | 3/2013 | | F25D 25/025 |
| WO | WO-2013042338 | A2 * | 3/2013 | | F25D 25/025 |

* cited by examiner

REFRIGERATOR APPLIANCE ANTI-RACKING SLIDING DRAWER

FIELD OF THE INVENTION

The present disclosure is related generally to refrigerator appliances, and more particularly to systems for anti-racking sliding drawers in a refrigerator appliance.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

However, refrigerator sliding drawers, such as produce drawers, vegetable drawers and freezer drawers, are typically mounted to the refrigerators case through a pair of independent drawer slides. These slides are generally uncontrolled with respect to each other, such that the front of the drawer may deviate out of parallel with respect to the case during drawer actuation. This deviation is undesirable and may lead to user belief of a low degree of craftsmanship, but further may negatively affect the mounting and functionality of the drawers.

Accordingly, a refrigerator with anti-racking sliding drawers therein would be advantageous.

BRIEF DESCRIPTION OF THE INVENTION

Aspects and advantages of the invention will be set forth in part in the following description, or may be obvious from the description, or may be learned through practice of the invention.

In one example embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a top portion and a bottom portion along the vertical direction, between a first side portion and a second side portion along the lateral direction, and between a front portion and a back portion along the transverse direction. A first support member and a second support member are disposed proximate the back portion of the food storage chamber for providing a plurality of shelf mounting positions. The refrigerator appliance also includes a slidably mountable drawer assembly. The slidably mountable drawer assembly includes a drawer. The drawer includes an exterior, an interior, and a chamber defined in the interior of the drawer. The chamber of the drawer defines a food storage compartment. A drawer flange extends laterally from both a first side of the drawer and a second side of the drawer. A first tab extends from the drawer flange on the first side of the drawer, and a second tab extends from the drawer flange on the second side of the drawer. The slidably mountable drawer assembly also includes a first rail extending along the transverse direction on the first side of the exterior of the drawer. The first rail comprising a first rail flange defining a first slot, the first slot configured to receive the first tab. A second rail extends along the transverse direction on the second side of the exterior of the drawer. The second side is opposite the first side. The second rail includes a second rail flange defining a second slot. The second slot is configured to receive the second tab. The drawer flange is configured to engage with both the first rail and the second rail. The first tab is configured to engage the first rail and the second tab is configured to engage the second rail.

In a second example embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a top portion and a bottom portion along the vertical direction, between a first side portion and a second side portion along the lateral direction, and between a front portion and a back portion along the transverse direction. The refrigerator appliance also includes a slidably mountable drawer assembly. The slidably mountable drawer assembly includes a drawer that includes an exterior, an interior, and a chamber defined in the interior of the drawer. The chamber of the drawer defines a food storage compartment. A first rail extends along the transverse direction on a first side of the exterior of the drawer. The first rail includes a first rail flange with a first slot defined in the first rail flange. A second rail extends along the transverse direction on a second side of the exterior of the drawer. The second side is opposite the first side. The second rail includes a second rail flange with a second slot defined in the second rail flange. A drawer flange extends laterally from both the first side and second side of the drawer. The drawer flange is configured to engage with both the first rail and the second rail. The drawer comprises one or more tabs extending from the drawer flange on at least one of the first side and second side of the drawer. The one or more tabs are each configured to engage a respective one of the first slot in the first rail or the second slot in the second rail.

In another example embodiment, a slidably mountable drawer assembly for a refrigerator appliance is provided. The drawer assembly includes a drawer defining a vertical direction, a lateral direction, and a transverse direction. The vertical, lateral, and transverse directions are mutually perpendicular. The drawer includes an exterior, an interior, and a chamber defined in the interior of the drawer. The chamber of the drawer defines a food storage compartment. A first rail extends along the transverse direction on a first side of the exterior of the drawer. The first rail includes a first rail flange with a first slot defined in the first rail flange. A second rail extends along the transverse direction on a second side of the exterior of the drawer. The second side is opposite the first side. The second rail includes a second rail flange with a second slot defined in the second rail flange. A drawer flange extends laterally from both the first side and second side of the drawer. The drawer flange is configured to engage with both the first rail and the second rail. The drawer comprises one or more tabs extending from the drawer flange on at least one of the first side and second side of the drawer. The one or more tabs are each configured to engage a respective one of the first slot in the first rail or the second slot in the second rail.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
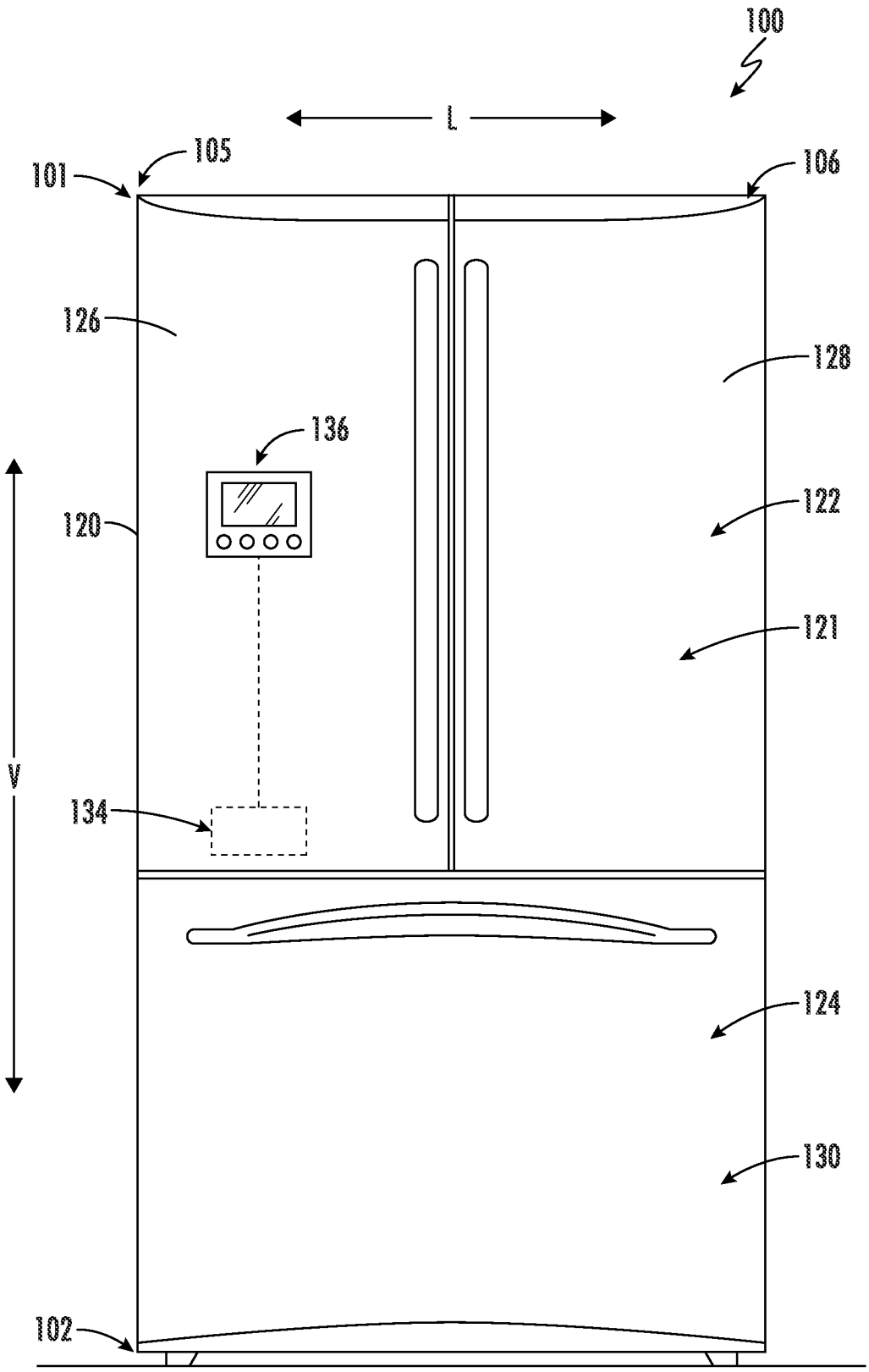
FIG. 1 provides a front view of a refrigerator appliance according to aspects of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

References to "an embodiment" or "one embodiment" does not necessarily refer to the same embodiment, although it may. Any implementation described herein as "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an example embodiment of the present subject matter. Refrigerator appliance 100 extends between a top portion 101 and a bottom portion 102 along a vertical direction V. Refrigerator appliance 100 also extends between a first side portion 105 and a second side portion 106 along a lateral direction L. A transverse direction T (FIG. 2) is defined perpendicular to the vertical and lateral directions V, L. Accordingly, vertical direction V, lateral direction L, and transverse direction T are mutually perpendicular.

Refrigerator appliance 100 includes a housing or cabinet 120 defining a volume 121 including at least one food storage chamber defined therein. In the illustrated example embodiment, cabinet 120 defines multiple food storage chambers, e.g., an upper fresh food chamber 122 and a lower freezer chamber 124 arranged below the fresh food chamber 122 on the vertical direction V. As such, refrigerator appliance 100 is generally referred to as a bottom mount refrigerator. In this example embodiment, cabinet 120 also defines a mechanical compartment (not shown) for receipt of a sealed cooling system (not shown). It will be appreciated that the present subject matter can be used with other types of refrigerators (e.g., side-by-sides), freezer appliances, and/or other types of appliances more generally. Consequently, the description set forth herein is for example purposes only and is not intended to limit the scope of the present subject matter in any aspect.

Refrigerator appliance 100 includes refrigerator doors 126, 128 that are rotatably hinged to an edge of cabinet 120 for accessing fresh food chamber 122. It should be noted that while doors 126, 128 are depicted in a "French door" configuration, any suitable arrangement or number of doors is within the scope and spirit of the present subject matter. A freezer door 130 is arranged below refrigerator doors 126, 128 for accessing freezer chamber 124.

Operation of refrigerator appliance 100 can be regulated by a controller 134 that is operatively coupled to a user interface panel 136. Panel 136 provides selections for user manipulation of the operation of refrigerator appliance 100. In response to user manipulation of user interface panel 136, controller 134 operates various components of refrigerator appliance 100. Controller 134 may include a memory and one or more processors, microprocessors, CPUs, or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 134 may be positioned in a variety of locations throughout refrigerator appliance 100. In the illustrated embodiment, controller 134 is located within door 126. In such an embodiment, input/output ("I/O") signals may be routed between the controller and various operational components of refrigerator appliance 100. In one embodiment, user interface panel 136 may represent a general purpose I/O ("GPIO") device or functional block. The user interface 136 may include input components, such as one or more of a variety of electrical, mechanical, or electro-mechanical input devices including rotary dials, push buttons, and touch pads. User interface 136 may include a display component, such as a digital or analog display device designed to provide operational feedback to a user. The user interface 136 may be in communication with controller 134 via one or more signal lines or shared communication busses.

Figure 2:
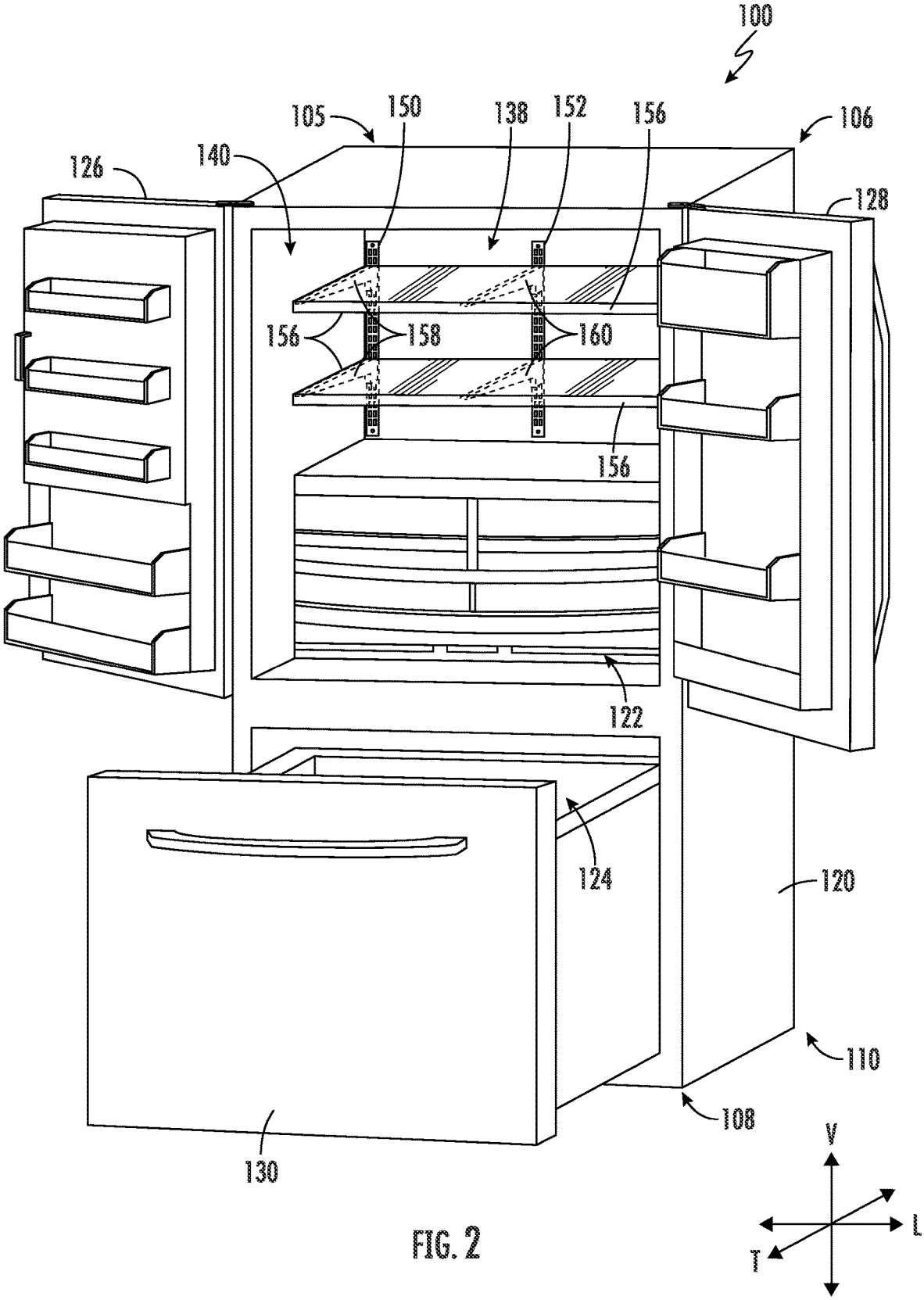
FIG. 2 provides a front perspective view of the refrigerator appliance of FIG. 1 with refrigerator doors and a freezer door shown in an open configuration according to aspects of the present disclosure.

FIG. 2 provides a front, perspective view of refrigerator appliance 100 having refrigerator doors 126, 128 in an open position to reveal the interior of fresh food chamber 122. Additionally, freezer door 130 is shown in an open position to reveal the interior of freezer chamber 124. As shown more clearly in FIG. 2, refrigerator appliance 100 extends in the transverse direction T between a front portion 108 and a back portion 110.

Figure 3:
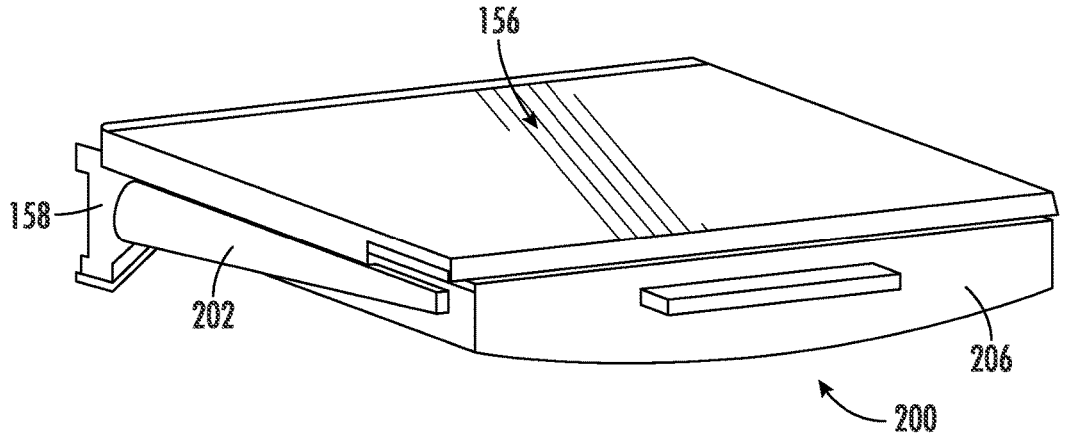
FIG. 3 provides a perspective view of a first position of a drawer assembly slidably mounted to a shelf, such as a shelf of the refrigerator appliance of FIG. 1 according to aspects of the present disclosure.

As shown in FIG. 2, for this example embodiment, fresh food chamber 122 of refrigerator appliance 100 includes a first support member 150 and a second support member 152 disposed proximate the back portion 110, e.g., mounted to a rear wall 138 of cabinet 120. The first and second support members 150 and 152 are oriented generally along the vertical direction V. One or more adjustable shelves 156 may be mounted to the first and second support members 150 and 152. First and second support members 150 and 152 structurally support one or more adjustable shelves 156. Moreover, first and second support members 150 and 152 structurally support the weight of other components, e.g., the additional weight from a slidably mountable drawer assembly 200 (FIG. 3). First and second support members 150 and 152 can be made of any suitable structural material. For example, in some embodiments, first and second support members 150 and 152 may be made of steel.

In the embodiment illustrated in FIG. 2, four (4) adjustable shelves 156 are mounted within fresh food chamber 122 and are arranged in two columns and two rows as shown. Adjustable shelves 156 may be selectively positioned by a user in different shelf mounting positions within fresh food chamber 122. For instance, one adjustable shelf 156 could be removed from its position and moved upward or downward along the vertical direction V or moved from a position proximate first side 105 to a position proximate second side 106 of refrigerator appliance 100 along the lateral direction L. Adjustable shelves 156 can also be removed from refrigerator appliance 100. For example, if storage room is needed for a particularly tall pot, adjustable shelves 156 can be removed from refrigerator appliance 100 and stowed elsewhere. Although four (4) adjustable shelves 156 are depicted in FIG. 2, more or less than four (4) adjustable shelves 156 can be provided in refrigerator appliance 100.

As shown in FIG. 2, each adjustable shelf 156 may include a first bracket 158 and a second bracket 160 for mounting the shelf 156 to the first and second support members 150 and 152 in one of the shelf mounting positions. For example, the shelf 156 may extend between the first bracket 158 and the second bracket 160 along the lateral direction L. As is generally understood in the art, the first and second support members 150 and 152 may include a plurality of openings and the first and second brackets 158 and 160 may include hooks configured to selectively engage and disengage the openings such that the shelves 156 can be positioned as desired.

Figure 4:
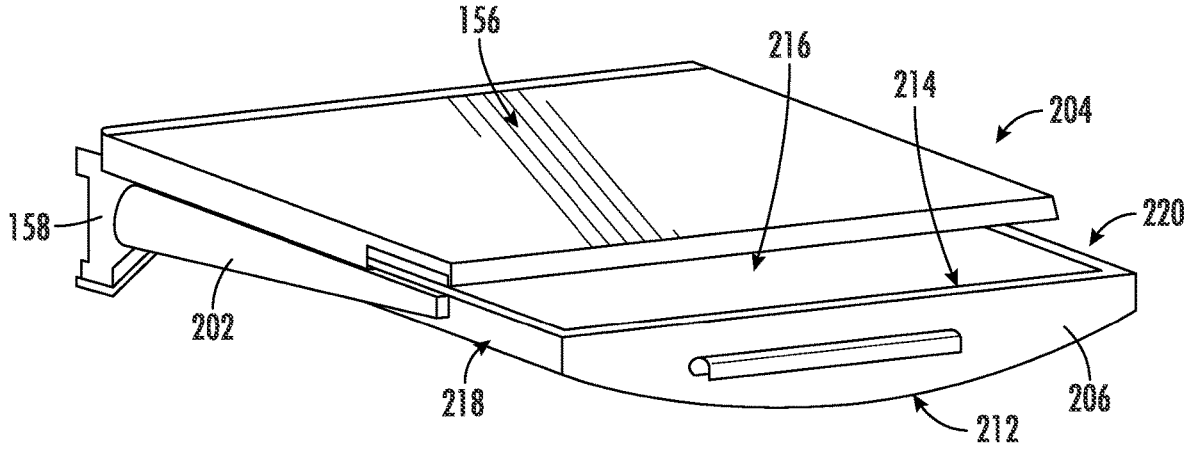
FIG. 4 provides a perspective view of the drawer assembly of FIG. 3 in a second position.

FIGS. 3 and 4 provide perspective views of a drawer assembly 200 slidably mounted to shelf 156. As illustrated, the slidably mountable drawer assembly 200 includes a first rail 202 and a second rail 204 with a drawer 206 therebetween. As shown in FIGS. 3 and 4, only first rail 202 is visible; however, a person having ordinary skill in the art will understand that a second mirrored rail 204 is also provided. In general, drawer 206 may include an exterior 212, such as an exterior surface, an interior 214, such as an interior surface, and a chamber 216 defined by interior 214 of drawer 206. For example, chamber 216 of drawer 206 may define a food storage compartment generally configured to receive food items for storage within refrigerator appliance 100. In general, drawer 206 may be mounted to rails 202, 204, as will be described in further detail hereinbelow. More specifically, drawer 206 may extend between a first side 218 and a second side 220 along the lateral direction L, where the second side 220 is opposite the first side 218. The first rail 202 may extend along the transverse direction T at the first side 218 of the drawer 206 and the second rail 204 may extend along the transverse direction T at the second side 220 of the drawer 206. In the present example embodiment, the first rail 202 and the second rail 204 of the drawer assembly 200 may be configured for slidably mounting to the first bracket 158 and the second bracket 160, respectively, proximate a bottom surface 154 of the shelf 156. Drawer 206 of the slidably mountable drawer assembly 200 may be slidable relative to the shelf 156, e.g., along the transverse direction T. For example, FIG. 3 illustrates drawer 206 in a first (closed) position and FIG. 4 illustrates drawer 206 in a second (open) position, whereby in the open position chamber 216 of drawer 206 may be exposed, such as for a user to retrieve or store food items.

Figure 5:
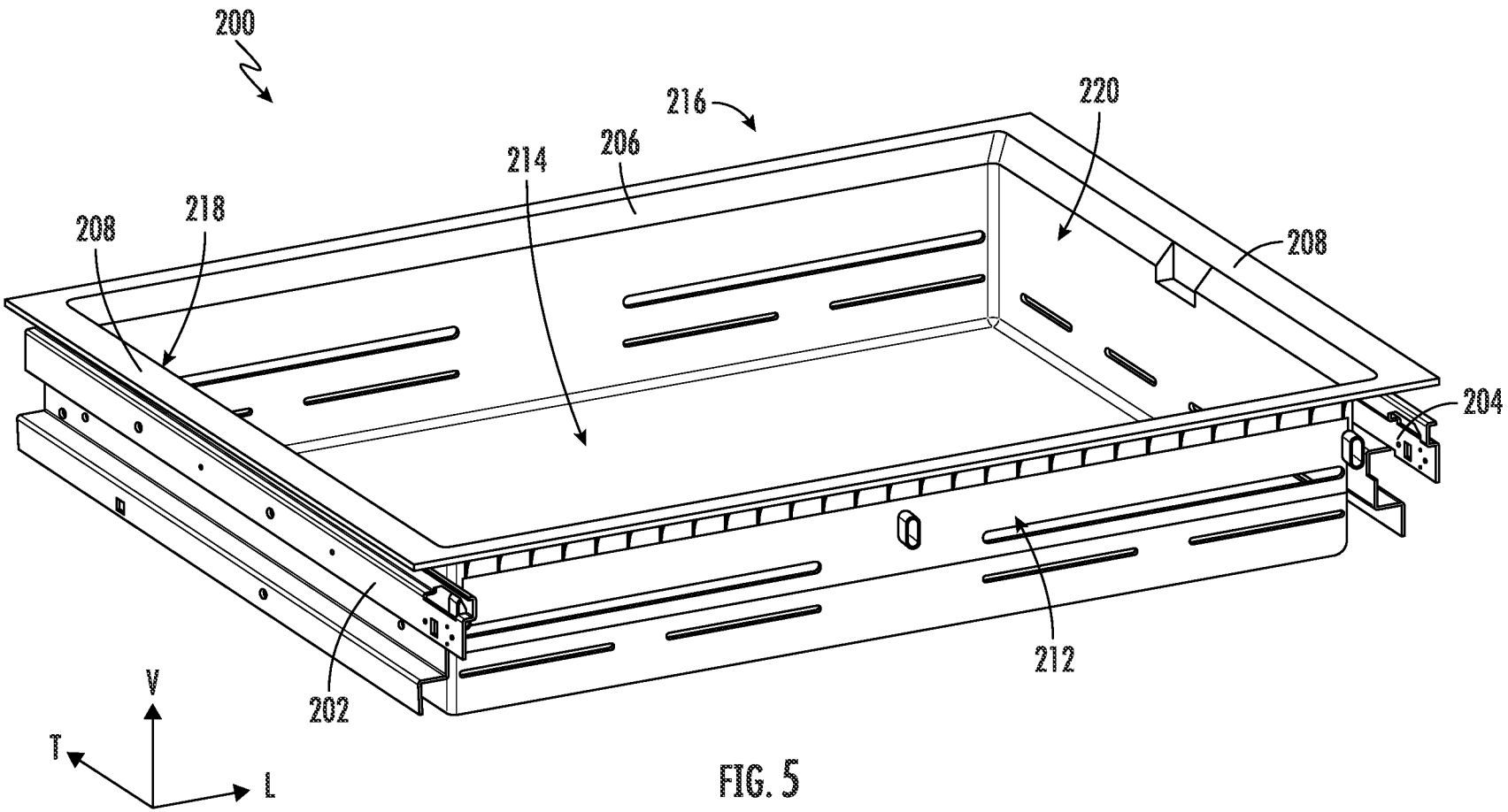
FIG. 5 provides a perspective view of an example embodiment of a drawer assembly according to aspects of the present disclosure.

Turning now to FIG. 5, illustrated is another example embodiment of drawer assembly 200. The present example embodiment may be a freezer drawer configured to translate generally along the transverse direction T within freezer chamber 124 and at least partially outside of the freezer chamber 124, e.g., when in an open position. More specifically, first and second rails 202, 204 may generally be configured to couple to the interior of freezer chamber 124, or couple to brackets (not shown) coupled to the interior of freezer chamber 124. Drawer assembly 200 may extend between a front side 210 (FIG. 7) and a back side 211 (FIG. 7) along the transverse direction T and include a drawer flange 208 extending laterally from both the first side 218 and second side 220 of drawer 206. Drawer flange 208 may generally be configured to engage with both the first rail 202 and the second rail 204, respectively, as will be described in further detail hereinbelow.

Figure 6:
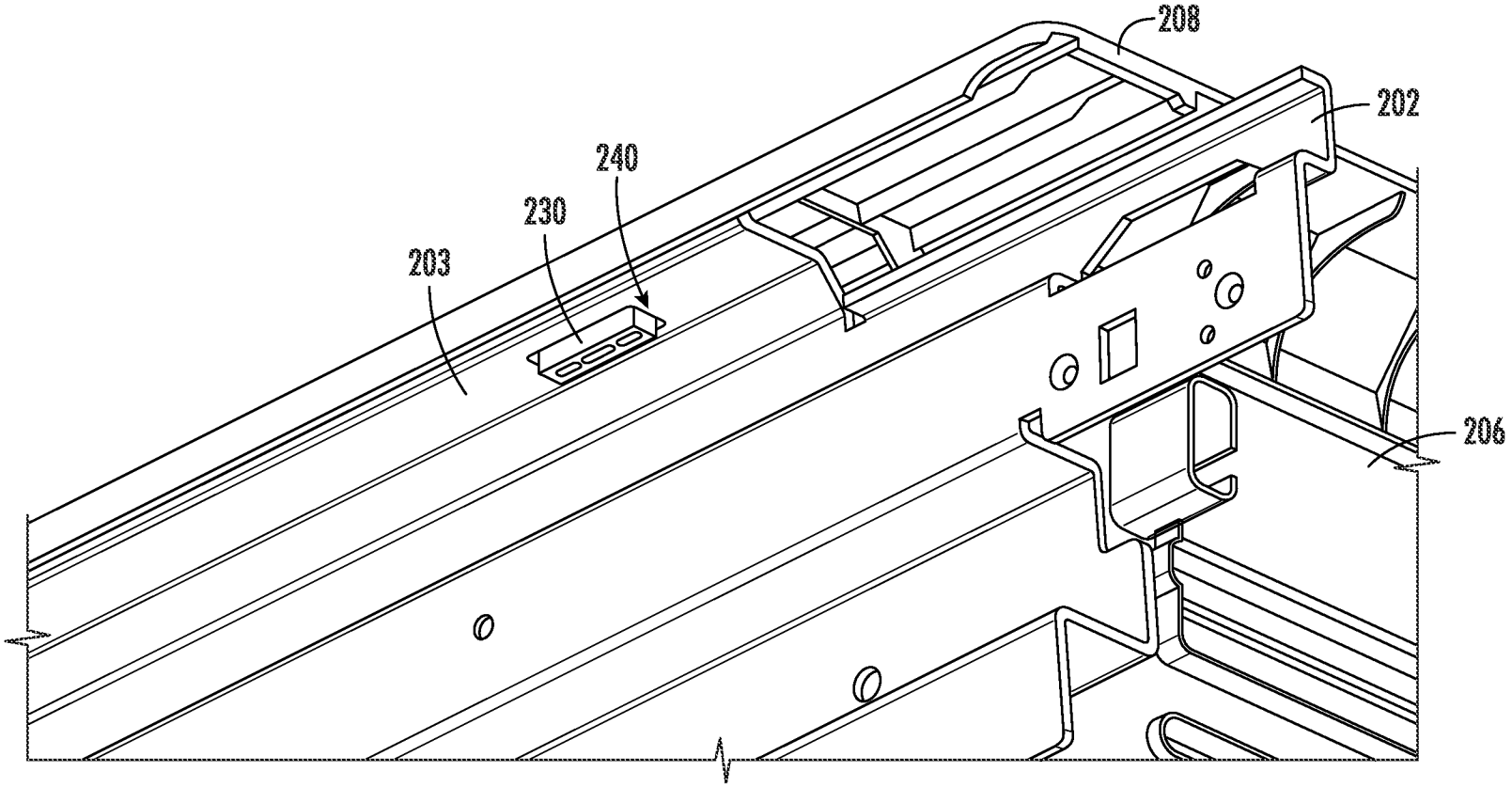
FIG. 6 provides a perspective section view of a portion of the drawer assembly of FIG. 5.

Referring now to FIG. 6, illustrated is an upward perspective view of a corner of drawer assembly 200, specifically illustrating drawer flange 208 engaging first rail 202. In general, drawer 206 may include a tab 230 extending, e.g., downward generally along the vertical direction V, from drawer flange 208 on each of the first side 218 and second side 220 of drawer 206. For example, each tab extending from the drawer flange 208 may engage either the first rail 202 or the second rail 204, respectively. In particular, each of first rail 202 and second rail 204 may include a rail flange extending therefrom, such as a first rail flange 203 of first rail 202 and a second rail flange 205 (FIG. 7) of second rail 204. Rail flange 203 may generally define a rail slot 240 configured to receive the tab 230 from drawer 206. In general, tab 230 may be formed with drawer 206, such as through injection molding or additive manufacturing, such that the drawer 206 and tab 230 are a single piece construction, thus advantageously reducing parts, such as fasteners, as used in traditional assemblies.

Figure 7:
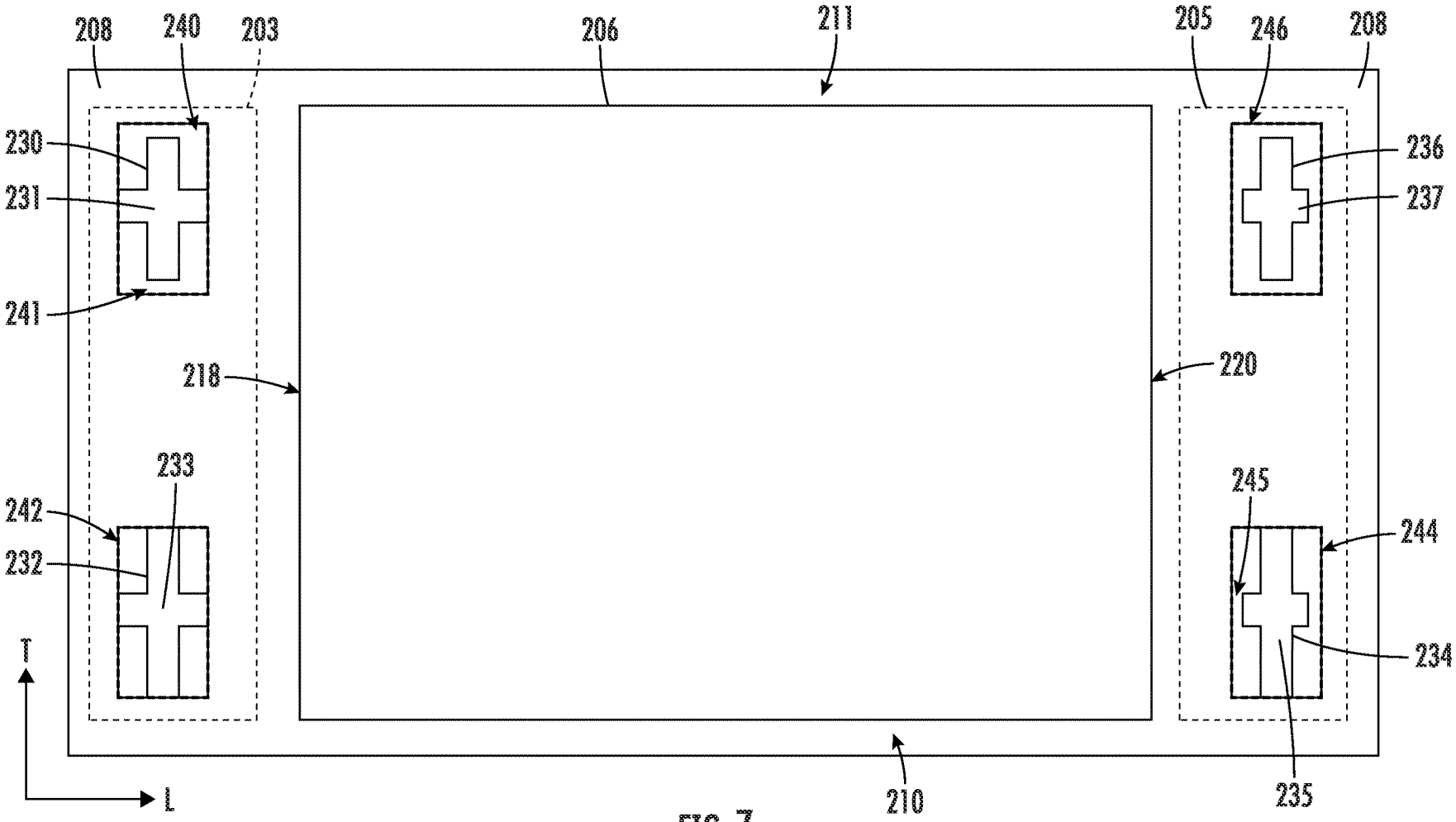
FIG. 7 provides a top, schematic view of the drawer assembly of FIG. 5 according to aspects of the present disclosure.

Turning now to FIG. 7, illustrated is a schematic view of an example embodiment of drawer assembly 200, and more specifically of example tabs of drawer 206 engaging respective slots of first rail 202 and second rail 204. In particular, in some example embodiments, drawer 206 may include at least three tabs extending from drawer flange 208 of drawer 206. For example, the first side 218 may include a first tab 230 and a third tab 232, and the second side 220 may include a second tab 234. The present illustrated embodiment also includes a fourth tab 236 extending from drawer flange 208 at the second side 218 of the drawer 206.

In general, each tab 230, 232, 234, 236 may include a respective protrusion within each respective slot 240, 242, 244, 246. In particular, the first tab 230 may include a first protrusion 231 extending in the lateral direction L, such that the first protrusion 231 may be configured to engage respective slot 240 of the first rail 202 along the lateral direction L. For example, first protrusion 231 may engage, e.g., push against or contact, slot 240 along the lateral direction L such as to reduce undesired lateral movement of drawer 206. The third tab 232 may include a third protrusion 233 generally extending in both of the lateral direction L and the transverse direction T, such that the third protrusion 233 may be configured to engage respective slot 242 of the first rail 202 in both the lateral direction L and the transverse direction T. For example, third protrusion 233 may engage, e.g., push against or contact, slot 242 along the lateral direction L and the transverse direction T such as to reduce undesired lateral and transverse movement of drawer 206. Accordingly, third protrusion 233 may be otherwise referred to as a four-way locator.

Moreover, the second tab 234 may include a second protrusion 235 extending in the transverse direction T, such that the second protrusion 235 may be configured to engage respective slot 244 of the second rail 204 along the transverse direction T. For example, second protrusion 235 may engage, e.g., push against or contact, slot 244 along the transverse direction T such as to reduce undesired transversal movement of drawer 206. In the present example embodiment, first tab 230 and second tab 234, more specifically first protrusion 231 and second protrusion 235, may define gaps, such as first gap 241 and second gap 245 from the respective slots 240, 244. For example, first protrusion 231 may be loosely fit, e.g., without contacting/engaging, within respective slot 240 with respect to the transverse direction T, and second protrusion 235 may be loosely fit within respective slot 244 with respect to the lateral direction L. Accordingly, each of first protrusion 231 and second protrusion 235 may be otherwise referred to as a two-way locator.

Additionally, the fourth tab 236 may include a fourth protrusion 237 generally configured to loosely fit, e.g., without contacting/engaging, respective slot 246 of the second rail 204. Fourth protrusion 237 may provide positional support for drawer 206, generally aiding assembly of drawer 206 to first and second rails 202, 204. Accordingly, first and second rails 202, 204 may operate in sync, e.g., to provide anti-racking and/or anti-canting control, along four horizontal degrees of freedom. For example, front-to-back translation along the transverse direction as well as side-to-side translation along the lateral direction of drawer 206 may be controlled via each tab 230, 232, 234, 236 engaging each respective slot 240, 242, 244, 246.

Additionally, the respective protrusions 231, 233, 235, 237 of tabs 230, 232, 234, 236 may control undesired horizontal rotation of drawer 206, while asserting mutual, e.g., simultaneous, front-to-back translation of the first and second rails 202, 204. In other words, third tab 232 may be a four-way locator and first tab 230 may be a side-to-side two-way locator. First tab 230 and third tab 232 may be paired on one side, e.g., the first side 218, of drawer 206 with first rail 202. In other example embodiments, first tab 230 and third tab 232 may be paired on the second side 220 of drawer 206 with second rail 204. Any arrangement of first tab 230 and third tab 232 may be suitable such that the pair (both first tab 230 and third tab 232) are positioned on the same side of drawer 206. Specifically, the combination of first tab 230 and third tab 232 controls three degrees of freedom of drawer 206, e.g., translation and rotation with respect to first rail 202, and the second rail 204 may have a single front-to-back two-way locator, e.g., second tab 234, to control translation of second rail 204 to first rail 202 (the fourth degree of freedom). As such, in some example embodiment, second tab 234 may be provided at any location along second side 220 of drawer 206. The fourth tab 236, as seen in FIG. 7 may generally maintain clearance in both directions (lateral and transverse) and may not further constrain the location of drawer 206 on first and second rails 202, 204.

Figure 8:
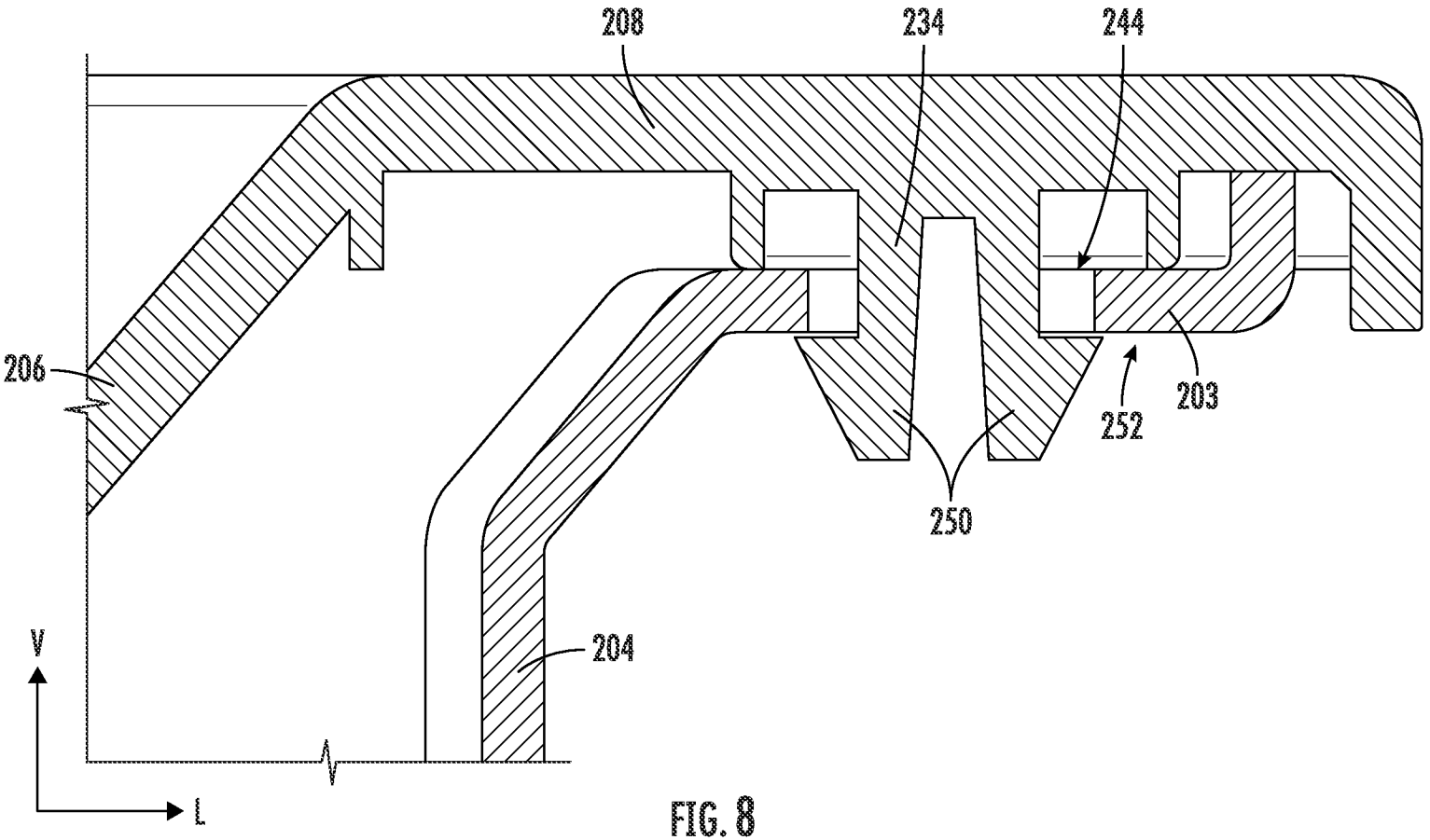
FIG. 8 provides a front, section view of the drawer assembly of FIG. 5 according to aspects of the present disclosure.

Turning now to FIG. 8, provided is a front, section view illustrating drawer flange 208 on second side 220 of drawer 206 engaging second rail 204. More specifically, illustrated is an example embodiment of second tab 234 engaging within respective slot 244 of second rail 204. As stated above, four horizontal degrees of freedom may be controlled the respective protrusions 231, 233, 235, 237 of tabs 230, 232, 234, 236 engaging the respective slots 240, 242, 244, 246, however, in some example embodiments, out-of-plane (such as the horizontal plane created by the lateral and transverse direction) torsional forces may cause drawer 206 to twist or plastically deform. For example, torsional forces may occur in scenarios where first rail 202 and second rail 204 apply inequal forces, e.g., such as a user pulling a handle of the drawer 206 off-center or a user pushing or twisting the drawer from side-to-side.

Accordingly, in order to reduce twisting (and thus increase control of the mutual translation of drawer 206 with respect to first and second rail 202, 204), drawer flange 208 may be retained to first and second rails 202, 204. In particular, the tabs, such as tabs 230, 232, 234, 236, extending from the drawer flange 208 may include a snap 250 configured to engage, in the vertical direction V, a bottom side 252 of the rail flange 203. In general, snap 250 may resist torsion of drawer 206. For example, snap 250 may be an integrated plastic snap, either integrated with tabs 230, 232, 234, 236, or in some example embodiments, integrated with drawer flange 208 such that snaps 250 extend from drawer flange 208 independently from tabs 230, 232, 234, 236. As such, in the present illustrated embodiment, snap 250 may engage, in the vertical direction V, with bottom side 252 of the second rail flange 205 such that torsion out of the horizontal plane created by the lateral and transverse direction may be reduced and/or controlled.

As may be seen from the above, provided may be locating and retention structures for a sliding drawer assembly in a refrigerator appliance. A drawer of drawer assembly may be slidable front-to-back via a pair of rails which may be otherwise independent of each other. The drawer may include a mounting flange around the top perimeter of the drawer which mounts on top of the rails. Multiple tabs may be provided on the underside of the bin mounting flange that protrude downward into corresponding slots within the rails. The tabs may provide control over four-degrees of motion, such as front-to-back and side-to-side translation of the drawer, horizontal rotation of the drawer, and mutual front-to-back translation of the rails. Accordingly, the provided structures for a sliding drawer assembly drawer may advantageously reduce parts count, parts cost, assembly complexity, and labor and increase perceived product quality from the user compared to traditional systems for sliding drawer assemblies in refrigerator appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a top portion and a bottom portion along the vertical direction, a first side portion and a second side portion along the lateral direction, and a front portion and a back portion along the transverse direction;

a first support member and a second support member disposed proximate the back portion of the food storage chamber for providing a plurality of shelf mounting positions; and a slidably mountable drawer assembly comprising:

a drawer comprising:

an exterior, an interior, a chamber defined in the interior of the drawer, the chamber of the drawer defining a food storage compartment, a drawer flange extending laterally from both a first side of the drawer and a second side of the drawer, a first tab extending from the drawer flange on the first side of the drawer, the first tab comprising a first protrusion, and a second tab extending from the drawer flange on the second side of the drawer;

a first rail extending along the transverse direction on the first side of the exterior of the drawer, the first rail comprising a first rail flange defining a first slot, the first slot configured to receive the first tab; and a second rail extending along the transverse direction on the second side of the exterior of the drawer, the second side opposite the first side, the second rail comprising a second rail flange defining a second slot, the second slot configured to receive the second tab;

wherein the drawer flange is configured to engage with both the first rail and the second rail, wherein the first tab is configured to engage the first rail and the second tab is configured to engage the second rail, and wherein the first tab defines a first gap between an edge of the first slot of the first rail flange and the first protrusion in the transverse direction, wherein the first protrusion extends in the lateral direction, the first protrusion engaging the first slot of the first rail in the lateral direction.

2. The refrigerator appliance of claim 1, wherein the drawer comprises at least three tabs, wherein the first side comprises the first tab and a third tab, and the second side comprises the second tab.

3. The refrigerator appliance of claim 2, wherein the third tab comprises a second protrusion extending in both the lateral direction and the transverse direction, the second protrusion configured to engage a third slot of the first rail in both the lateral direction and the transverse direction.

4. The refrigerator appliance of claim 2, wherein the second tab comprises a third protrusion extending in the transverse direction, the third protrusion configured to engage the second slot of the second rail in the transverse direction.

5. The refrigerator appliance of claim 2, further comprising a fourth tab extending from the second side of the drawer, the fourth tab comprising a fourth protrusion configured to loosely fit within a fourth slot of the second rail.

6. The refrigerator appliance of claim 1, wherein the first tab extending from the drawer flange comprises a first snap configured to engage, in the vertical direction, a bottom side of the first rail flange.

7. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a top portion and a bottom portion along the vertical direction, a first side portion and a second side portion along the lateral direction, and a front portion and a back portion along the transverse direction;

a slidably mountable drawer assembly comprising:

a drawer comprising an exterior, an interior, and a chamber defined in the interior of the drawer, the chamber of the drawer defining a food storage compartment;

a first rail extending along the transverse direction on a first side of the exterior of the drawer, the first rail comprising a first rail flange with a first slot defined in the first rail flange;

a second rail extending along the transverse direction on a second side of the exterior of the drawer, the second side opposite the first side, the second rail comprising a second rail flange with a second slot defined in the second rail flange; and a drawer flange extending laterally from both the first side and second side of the drawer, the drawer flange configured to engage with both the first rail and the second rail, a first tab extending from the drawer flange, the first tab comprising a first protrusion; and a second tab extending from the drawer flange;

wherein the first tab extending from the drawer flange is on the first side of the drawer and the second tab extending from the drawer flange is on the second side of the drawer, wherein the first tab and the second tab one or more tabs are each configured to engage a respective one of the first slot in the first rail or the second slot in the second rail, and wherein the first tab defines a first gap between an edge of the first slot of the first rail flange and the first protrusion in the transverse direction, wherein the first protrusion extends in the lateral direction, the first protrusion engaging the first slot of the first rail in the lateral direction.

8. The refrigerator appliance of claim 7, wherein the tabs of the drawer comprises at least three tabs, the at least three tabs comprising the first tab and a third tab extending from the drawer flange on the first side of the drawer and the second tab extending from the drawer flange on the second side of the drawer.

9. The refrigerator appliance of claim 8, wherein the third tab comprises a second protrusion extending in both the lateral direction and the transverse direction, the second protrusion configured to engage a third slot of the first rail in both the lateral direction and the transverse direction.

10. The refrigerator appliance of claim 8, wherein the second tab comprises a third protrusion extending in the transverse direction, the third protrusion configured to engage the second slot of the second rail in the transverse direction.

11. The refrigerator appliance of claim 8, further comprising a fourth tab extending from the drawer flange on the second side of the drawer, the fourth tab comprising a fourth protrusion configured to loosely fit within a fourth slot defined in the second rail flange of the second rail.

12. The refrigerator appliance of claim 7, wherein each tab of the tabs extending from the drawer flange comprises a snap configured to engage, in the vertical direction, a bottom side of one of the first rail flange or the second rail flange.

13. A slidably mountable drawer assembly for a refrigerator appliance, the drawer assembly comprising:

a drawer defining a vertical direction, a lateral direction, and a transverse direction, the vertical, lateral, and transverse directions being mutually perpendicular, the drawer comprising an exterior, an interior, and a chamber defined in the interior of the drawer, the chamber of the drawer defining a food storage compartment;

a first rail extending along the transverse direction on a first side of the exterior of the drawer, the first rail configured to couple to the refrigerator appliance, the first rail comprising a first rail flange defining a first slot;

a second rail extending along the transverse direction on a second side of the exterior of the drawer, the second side opposite the first side, the second rail configured to couple to the refrigerator appliance, the second rail comprising a second rail flange defining a second slot; and a drawer flange extending laterally from both the first side and second side of the drawer, the drawer flange configured to engage with both the first rail and the second rail, wherein the drawer comprises one or more tabs extending from the drawer flange on at least one of the first side and second side of the drawer, each tab extending from the drawer flange configured to engage either the first slot defined in the first rail flange of the first rail or the second slot defined in the second rail flange of the second rail, wherein the one or more tabs comprises a first tab extending from the drawer flange at the first side of the drawer, the first tab comprising a first protrusion, wherein the first tab defines a first gap between an edge of the first slot of the first rail flange and the first protrusion in the transverse direction, wherein the first protrusion extends in the lateral direction, the first protrusion engaging the first slot of the first rail in the lateral direction.

14. The refrigerator appliance of claim 13, wherein the one or more tabs of the drawer comprises at least three tabs, the at least three tabs comprising the first tab and a third tab extending from the drawer flange on the first side of the drawer and a second tab extending from the drawer flange on the second side of the drawer.

15. The refrigerator appliance of claim 14, wherein the third tab comprises a second protrusion extending in both the lateral direction and the transverse direction, the second protrusion configured to engage a third slot of the first rail in both the lateral direction and the transverse direction.

16. The refrigerator appliance of claim 14, wherein the second tab comprises a third protrusion extending in the transverse direction, the third protrusion configured to engage the second slot of the second rail in the transverse direction.

17. The refrigerator appliance of claim 13, wherein each tab of the one or more tabs extending from the drawer flange comprises a snap configured to engage, in the vertical direction, a bottom side of one of the first rail flange or the second rail flange.

* * * * *